US012446682B2

(12) United States Patent
Chen

(10) Patent No.: US 12,446,682 B2
(45) Date of Patent: Oct. 21, 2025

(54) CLEANING BRUSH

(71) Applicant: shenzhen alisen trading co., ltd, Shenzhen (CN)

(72) Inventor: XiaoQing Chen, Shenzhen (CN)

(73) Assignee: shenzhen alisen trading co., ltd, Shenzhen (CN)

( * ) Notice: Subject to any disclaimer, the term of this patent is extended or adjusted under 35 U.S.C. 154(b) by 581 days.

(21) Appl. No.: 17/822,644

(22) Filed: Aug. 26, 2022

(65) Prior Publication Data

US 2024/0065431 A1 Feb. 29, 2024

(51) Int. Cl.
*A46B 15/00* (2006.01)
*A46B 5/00* (2006.01)

(52) U.S. Cl.
CPC ..... *A46B 15/0081* (2013.01); *A46B 5/0095* (2013.01)

(58) Field of Classification Search
CPC ..... A46B 15/0081
USPC ..... 15/111
See application file for complete search history.

(56) References Cited

U.S. PATENT DOCUMENTS 6,443,646 B1 * 9/2002 MacDonald ..... A46B 11/00 401/39
6,966,094 B1 * 11/2005 Rigakos ..... A47J 37/0786 15/236.01
D629,984 S * 12/2010 Carlson ..... D32/51
8,032,974 B2 * 10/2011 Carpenter ..... A47J 43/288 15/229.11
8,615,838 B1 * 12/2013 Lu ..... A46B 15/0081 15/160
8,844,087 B2 * 9/2014 Marsden ..... A46B 17/08 15/236.01
9,210,993 B2 * 12/2015 Gonzalez ..... A47J 37/0786
D911,647 S * 2/2021 Sarabia ..... D32/46
D945,728 S * 3/2022 Mobley ..... D32/46
D945,730 S * 3/2022 Mobley ..... D4/137
D946,850 S * 3/2022 Mobley ..... D4/137
2006/0207042 A1 * 9/2006 Di Paolo ..... A47L 13/34 15/160
2007/0231054 A1 * 10/2007 Wales ..... A46B 5/0008 401/25
2008/0178404 A1 * 7/2008 Wales ..... A47L 13/06 401/282
2017/0188696 A1 * 7/2017 Neal ..... A46B 7/046
2018/0140085 A1 * 5/2018 Mills ..... A46B 15/0081
2019/0069667 A1 * 3/2019 Prior ..... A46B 9/005

(Continued)

FOREIGN PATENT DOCUMENTS

WO WO-2009014749 A1 * 1/2009 ..... A46B 11/0013

*Primary Examiner* — Marc Carlson
(74) *Attorney, Agent, or Firm* — Justin Lampel

(57) ABSTRACT

The present disclosure provides a cleaning brush, which includes a brush holder and a cleaning assembly connected with the brush holder, the brush holder includes a main body, a grip end, and a cleaning end, the grip end and the cleaning end are arranged at two opposite ends of the main body respectively, the holding end can be held by the user, and the cleaning end can be used to clean target objects, the mounting seat of the cleaning assembly is detachably connected to the cleaning end, the bristles and the scraper are connected to the mounting seat, a side of an cutting edge of the scraper towards the mounting seat is recessed to form a profile cleaning groove.

14 Claims, 6 Drawing Sheets

(56) References Cited

U.S. PATENT DOCUMENTS

| | | | | |
|---|---|---|---|---|
| 2022/0218096 | A1* | 7/2022 | Magnani | A46B 5/02 |
| 2024/0065431 | A1* | 2/2024 | Chen | A46B 5/0095 |

* cited by examiner

CLEANING BRUSH

FIELD

The present disclosure relates to a technical field of cleaning appliances, specifically to a cleaning brush.

BACKGROUND

In a related art, the cleaning brush is laborious and inefficient to clean stubborn dirt on a surface of a rod-shaped profile. Generally speaking, due to a limited contact area between the rod-shaped profile with a circular arc-shaped cross-section and a scraper, it is necessary to move the scraper repeatedly in an extending direction of the profile to clean the stubborn dirt on the surface. The overall process is time-consuming and laborious.

SUMMARY

The main purpose of the present disclosure is to provide a cleaning brush, aiming to improve a cleaning efficiency of the rod-shaped profile.

In order to achieve the above purpose, the cleaning brush provided by the present disclosure includes:

a brush holder, including a main body, a grip end, and a cleaning end, the grip end and the cleaning end are arranged at two opposite ends of the main body, respectively; and a cleaning assembly, including a mounting seat, bristles, and a scraper, the mounting seat is detachably connected to the cleaning end, the bristles and the scraper are connected to the mounting seat, a side of an cutting edge of the scraper towards the mounting seat is recessed to form a profile cleaning groove.

Electively, a side of the profile cleaning groove towards the cutting edge is arranged in a flared shape.

Electively, a bottom wall of the profile cleaning groove is in a circular arc shape.

Electively, the scraper defines a plurality of through holes penetrating through upper and lower surfaces of the scraper, the cleaning assembly further includes a plurality of connecting elements, the mounting seat includes a first seat body and a second seat body, the first seat body defines a plurality of connecting holes, and the second seat body defines a plurality of mounting holes, the first seat body is detachably connected to the cleaning end, and the bristles are connected to the second seat body; and the scraper is clamped between the first seat body and the second seat body, and one connecting element is passed through one connecting hole, one through hole and one mounting hole, to connect the scraper with the first seat body and the second seat body.

Electively, a plurality of positioning posts are protruded from a surface of the second seat body towards the first seat body, one positioning post defines one mounting hole, a surface of the first seat body towards the second seat body is recessed to form a plurality of positioning holes, and one positioning hole is communicated with one connecting hole; and one positioning post is passed through one through hole and inserted into one positioning holes.

Electively, the cleaning end defines an inserting hole, and a side of the first seat body towards the cleaning end includes a connecting protrusion, and the connecting protrusion is inserted into the inserting hole, to connect the second set body with the cleaning end.

Electively, one of a side wall of the inserting hole and the connecting protrusion includes an external thread, and another one of the inserting hole and the connecting protrusion includes an internal thread.

Electively, the mounting seat further includes a plurality of anti-slip protrusions, and the anti-skid protrusions are arranged at intervals on an outer side of the first seat body and are evenly spaced along a circumferential direction of the first seat body.

Electively, the bristles are made of fireproof cloth.

Electively, the main body is extended in a circular arc shape, and a center of the circular arc is arranged on a side of the mounting seat.

In the technical solution of the present disclosure, the cleaning brush includes a brush holder and a cleaning assembly connected with the brush holder, the brush holder includes a main body, a grip end, and a cleaning end, the grip end and the cleaning end are arranged at two opposite ends of the main body respectively, the holding end can be held by the user, and the cleaning end can be used to clean target objects, the mounting seat of the cleaning assembly is detachably connected to the cleaning end, the bristles and the scraper are connected to the mounting seat, a side of an cutting edge of the scraper towards the mounting seat is recessed to form a profile cleaning groove. Through setting the bristles and the scraper, the cleaning brush of the present disclosure has a better the cleaning performance, that is, the bristles can remove conventional stains, and the scraper can remove stubborn stains and blocky attachments. At the same time, by setting the profile cleaning groove on one side of the cutting edge, when cleaning the rod-shaped profile, most parts of the rod-shaped profile are embedded in the profile cleaning groove, which increases a contact area between the scraper and the rod-shaped profile. So that, when moving the scraper once, most of the stains on the surface of the rod-shaped profile can be removed, which not only improves the cleaning efficiency of the rod-shaped profile, but also achieves a better cleaning effect.

BRIEF DESCRIPTION OF THE DRAWINGS

Implementations of the present disclosure will now be described, by way of embodiment, with reference to the attached FIGS. It should be understood, the drawings are shown for illustrative purpose only, for ordinary person skilled in the art, other drawings obtained from these drawings without paying creative labor by an ordinary person skilled in the art should be within scope of the present disclosure.

Labels illustration for drawings.

Figure 1:
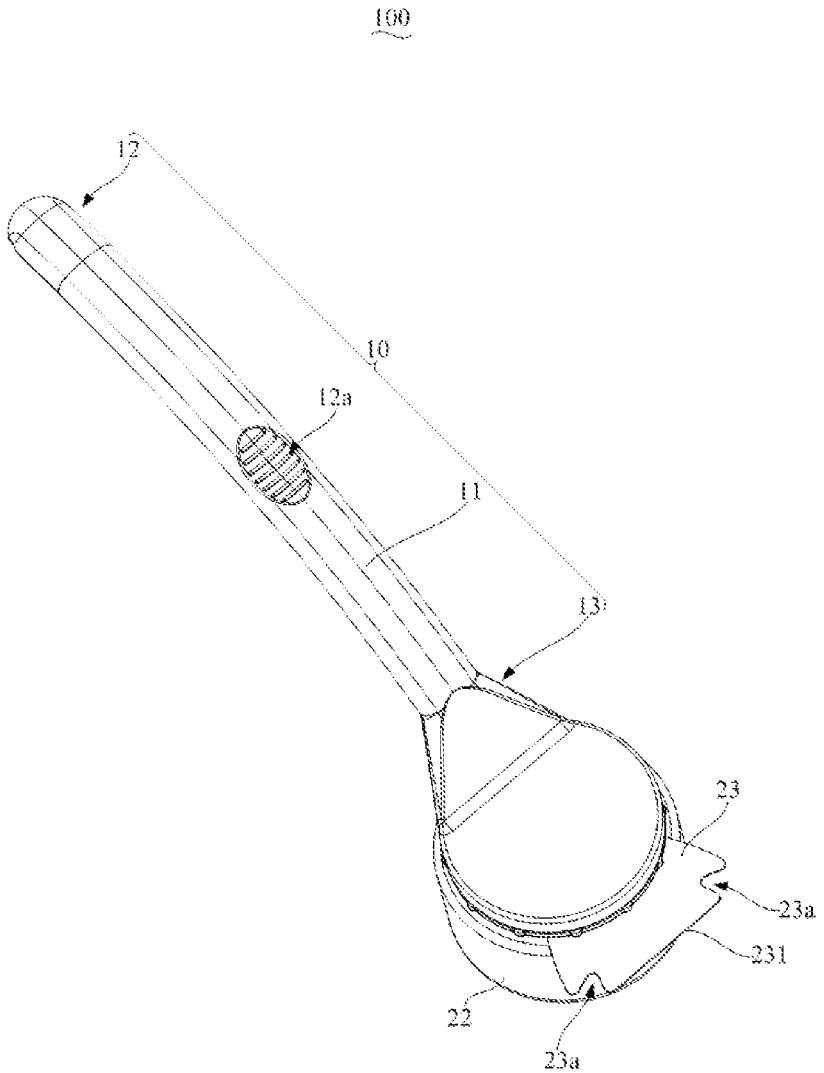
FIG. 1 is a structure view of a cleaning brush according to an embodiment of the present disclosure.

| Label | Name | Label | Name |
|---|---|---|---|
| 100 | cleaning brush | 211b | positioning hole |
| 10 | brush holder | 2112 | connecting protrusion |
| 11 | main body | 212 | second seat body |
| 12 | grip end | 2121 | mounting hole |

-continued

| Label | Name | Label | Name |
|---|---|---|---|
| 12a | pressing groove | 212a | mounting hole |
| 13 | cleaning end | 213 | anti-slip protrusion |
| 13a | inserting hole | 22 | bristles |
| 20 | cleaning assembly | 23 | scraper |
| 21 | mounting seat | 231 | cutting edge |
| 211 | first seat body | 23a | profile cleaning groove |
| 211a | connecting hole | 23b | through hole |

The realization of the aim, functional characteristics, advantages of the present disclosure are further described specifically with reference to the accompanying drawings and embodiments.

DETAILED DESCRIPTION

The technical solutions of the embodiments of the present disclosure will be clearly and completely described in the following with reference to the accompanying drawings. It is obvious that the embodiments to be described are only a part rather than all of the embodiments of the present disclosure. All other embodiments obtained by persons skilled in the art based on the embodiments of the present disclosure without creative efforts shall fall within the protection scope of the present disclosure.

It is to be understood that, all of the directional instructions in the exemplary embodiments of the present disclosure (such as top, down, left, right, front, back) can only be used for explaining relative position relations, moving condition of the elements under a special form (referring to figures), and so on, if the special form changes, the directional instructions changes accordingly.

In addition, the descriptions, such as the "first", the "second" in the present disclosure, can only be used for describing the aim of description, and cannot be understood as indicating or suggesting relative importance or impliedly indicating the number of the indicated technical character. Therefore, the character indicated by the "first", the "second" can express or impliedly include at least one character. In addition, the technical proposal of each exemplary embodiment can be combined with each other, however the technical proposal must base on that the ordinary skill in that art can realize the technical proposal, when the combination of the technical proposals occurs contradiction or cannot realize, it should consider that the combination of the technical proposals does not existed, and is not contained in the protection scope required by the present disclosure.

Referring to FIGS. 1 to 6, the present disclosure provides a cleaning brush 100.

In an embodiment of the present disclosure, the cleaning brush 100 includes:

- a brush holder 10, including a main body 11, a grip end 12, and a cleaning end 13, the grip end 12 and the cleaning end 13 are arranged at two opposite ends of the main body 11, respectively;
- a cleaning assembly 20, including a mounting seat 21, bristles 22, and a scraper 23, the mounting seat 21 is detachably connected to the cleaning end 13, the bristles 22 and the scraper 23 are connected to the mounting seat 21, a side of an cutting edge 231 of the scraper 23 towards the mounting seat 21 is recessed to form a profile cleaning groove 23*a*.

Specifically, the main body 11, the grip end 12, and the cleaning end 13 of the brush holder 10 can be integrally formed by metal profiles or plastic materials. In the present disclosure, the main body 11 is extended to have a rod-like shape, and its extending trajectory is in a circular arc shape, and a cross section of the main body 11 is in an ellipse shape. In this way, the main body 11 not only has a better anti-bending performance, but also has a better grip sense, so the user experience and the service life of the brush handle 10 are improved simultaneously. The grip end 12 and the cleaning end 13 are arranged at two opposite ends of the main body 11 which is extended to have the rod-like shape. A surface of the grip end 12 defines a plurality of anti-slip protruding strips (not shown) and a plurality of pressing grooves 12*a*, the pressing grooves 12*a* are arranged above the anti-slip protruding strips. In the present disclosure, through setting the anti-slip protruding strips and the pressing grooves 12*a*, user can not only grip the main body 11 more stably, but also can press hard on the grip end 12 conveniently, then the force from user can be applied to the cleaning end 13 to improve the cleaning effect of the cleaning assembly 20.

The mounting seat 21 of the cleaning assembly 20 is detachably connected to the cleaning end 13, the bristles 22 and the scraper 23 are connected to the mounting seat 21, and the scraper 23 can be formed of metal or hard plastic. Preferably, the scraper 23 can be formed of metal, so the service life of the scraper 23 which is made of metal is longer. The bristles 22 can be made of sponge, cloth or metal. The bristles 22 of the present disclosure are preferably made of fireproof cloth, and are bonded to the mounting seat 21 by glue. The bristles 22 made of fireproof cloth have a high temperature resistance, and can prevent metal chips or other impurities from falling off into the appliance when cleaning the target appliance, thereby preventing an accidental swallowing. The cutting edge 231 of the scraper 23 is machined to form the profile cleaning groove 23*a*, and the side of the profile cleaning groove 23*a* towards the mounting seat 21 is recessed.

Through setting the bristles 22 and the scraper 23, the cleaning brush 100 of the present disclosure has a better the cleaning performance, that is, the bristles 22 can remove conventional stains, and the scraper 23 can remove stubborn stains and blocky attachments. At the same time, by setting the profile cleaning groove 23*a* on one side of the cutting edge 231, when cleaning the rod-shaped profile, most parts of the rod-shaped profile are embedded in the profile cleaning groove 23*a*, which increases a contact area between the scraper 23 and the rod-shaped profile. So that, when moving the scraper 23 once, most of the stains on the surface of the rod-shaped profile can be removed, which not only improves the cleaning efficiency of the rod-shaped profile, but also achieves a better cleaning effect.

In a specific embodiment of the present disclosure, the cleaning brush 100 is used to clean barbecue utensils, and user can remove the stubborn stains on surfaces of a barbecue plate and a barbecue dish by the scraper 23, and a barbecue mesh rod can be embedded in the profile cleaning groove 23*a*, so the cleaning efficiency and cleaning effect of a barbecue mesh can be the greatly improved. At the same time, the bristles 22 made of high temperature resistant fireproof cloth can clean the barbecue utensils in a high temperature state, and the cleaning effect is further improved. It can also be known from the above process that the cleaning brush 100 of the present disclosure has at least two functions of scraping off stains and brushing off stains, and also has a better cleaning effect on rod-shaped profiles, so the cleaning brush 100 has a better cleaning effect.

It can be understood that, the "grip end 12" and "cleaning end 13" of the present disclosure are referred to portions formed by extending ends of the main body 11 towards the middle of the main body 11 by a certain distance. The grip end 12 and the cleaning end 13 can be set according to actual needs, which are not specifically limited here.

Figure 3:
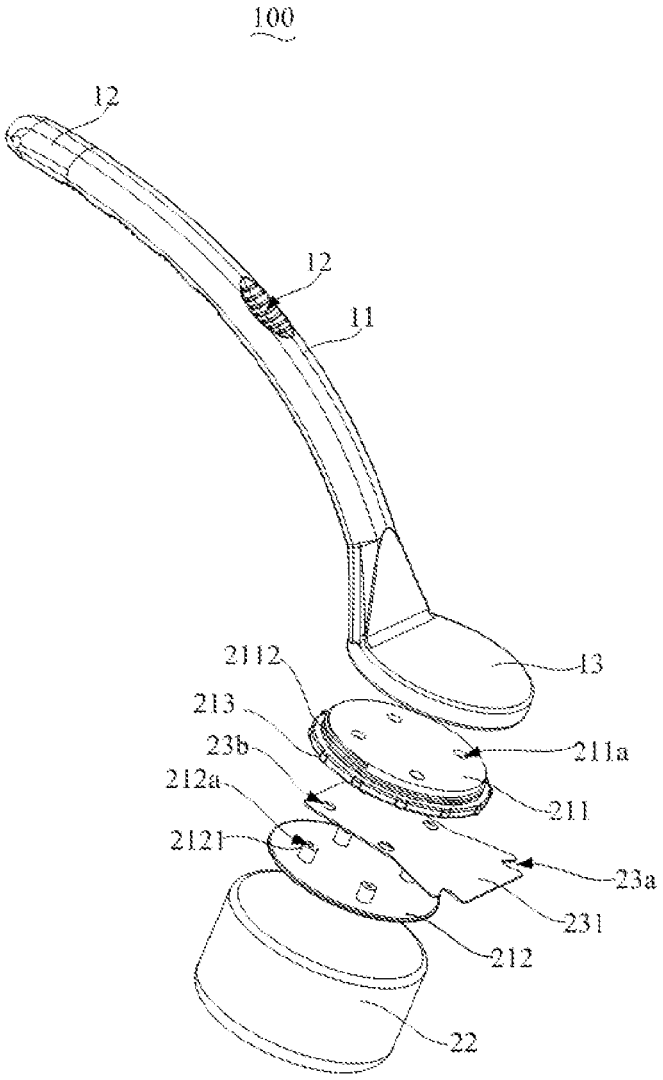
FIG. 3 is similar to FIG. 1, but shown from another view.
Figure 4:
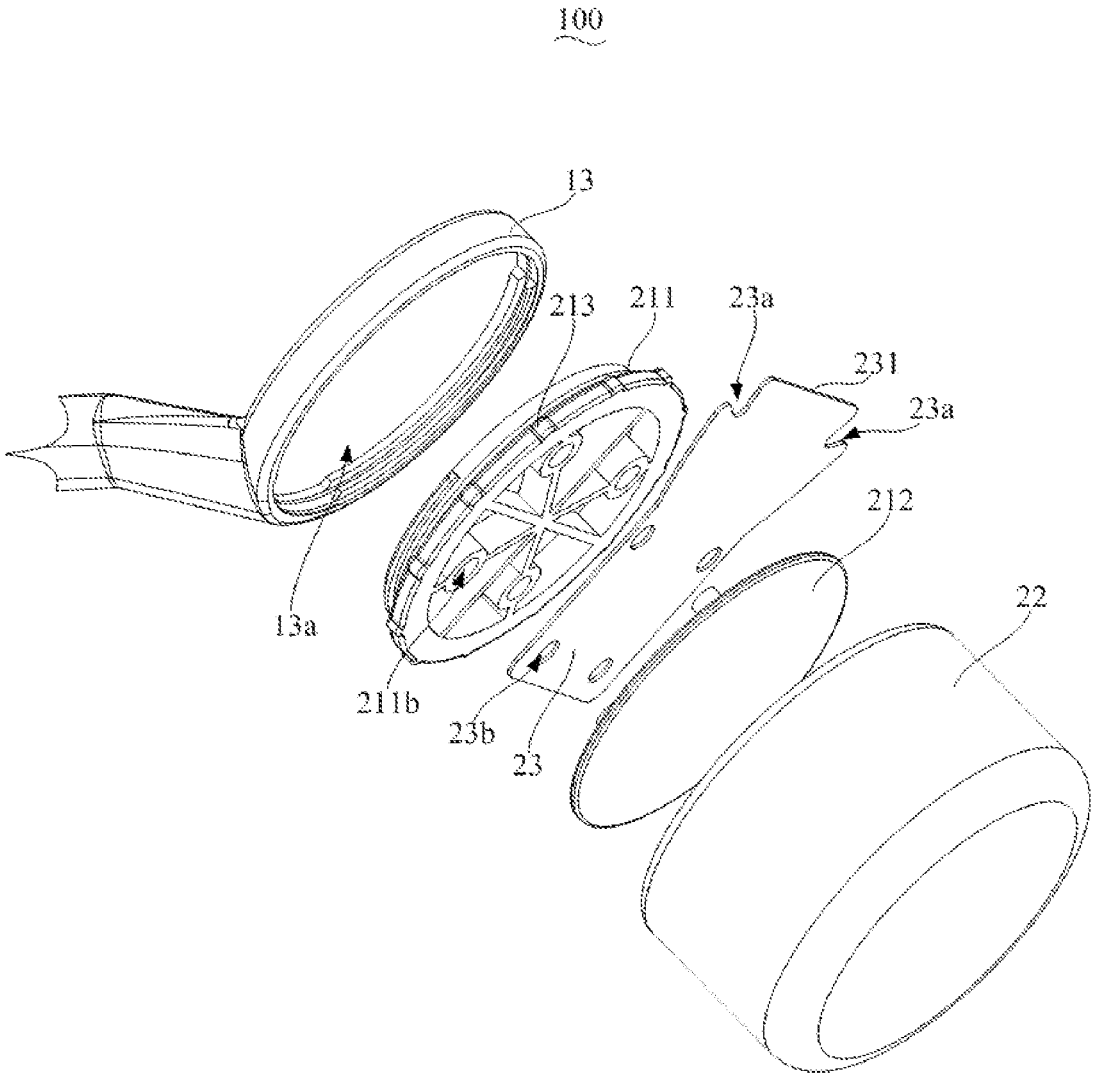
FIG. 4 is similar to FIG. 1, but shown from a further view.
Figure 5:
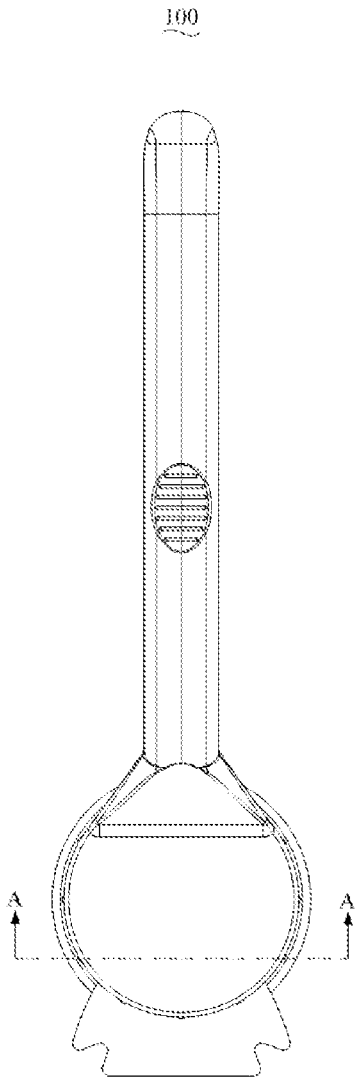
FIG. 5 is a top view of the cleaning brush of FIG. 1.

Please referring to FIG. 3 and FIG. 4 again, in an embodiment of the present disclosure, a side of the profile cleaning groove 23*a* towards the cutting edge 231 is arranged in a flared shape. That is, in the present disclosure, the side of the profile cleaning groove 23*a* towards the cutting edge 231 is in a "V" shape. In the present disclosure, as the profile cleaning groove 23*a* has the flared shape, the profile cleaning groove 23*a* can better accommodate rod-shaped profiles with different rod diameters, and the cleaning brush 100 can be better applied to cleaning rod-shaped profiles with different rod diameters, and has a better compatibility.

Further, a bottom wall of the profile cleaning groove 23*a* is extended to have a circular arc shape. Generally speaking, in order to facilitate processing and manufacturing, a cross section of commercially available rod-shaped profile is generally circular. In the present disclosure, the bottom wall of the profile cleaning groove 23*a* with the circular arc shape can fit the commercially available rod-shaped profiles to the greatest extent, so that the compatibility of the cleaning brush 100 is better.

In the present disclosure, the cutting edge 231 of the scraper 23 is provided with two profile cleaning grooves 23*a*, and the two profile cleaning grooves 23*a* have the same shape and are symmetrically arranged in the surface of the scraper 23. So that, when cleaning the rod-shaped profiles, the overall force applied to the scraper 23 is more balanced. Of course, the profile cleaning groove 23*a* can also be set in other shapes, such as oval, square, triangle, etc. The number of the profile cleaning groove 23*a* can also be specifically set according to design requirements, which is not specifically limited here.

It can be understood that, in actual use, the existing scraper may be subjected to a relatively large force and needs to be replaced frequently. So in order to facilitate the disassembly and assembly of the scraper 23, in an embodiment of the present disclosure, the scraper 23 is provided with a plurality of through holes 23*b* penetrating through upper and lower surfaces of the scraper 23. The cleaning assembly 20 further includes a plurality of connecting elements (not shown). The mounting seat 21 includes a first seat body 211 and a second seat body 212. The first seat body 211 is provided with a plurality of connecting holes 211*a*, and the second seat body 212 is provided with a plurality of mounting holes 212*a*. The first seat body 211 is detachably connected to the cleaning end 13, and the bristles 22 are connected to the second seat body 212.

Figure 6:
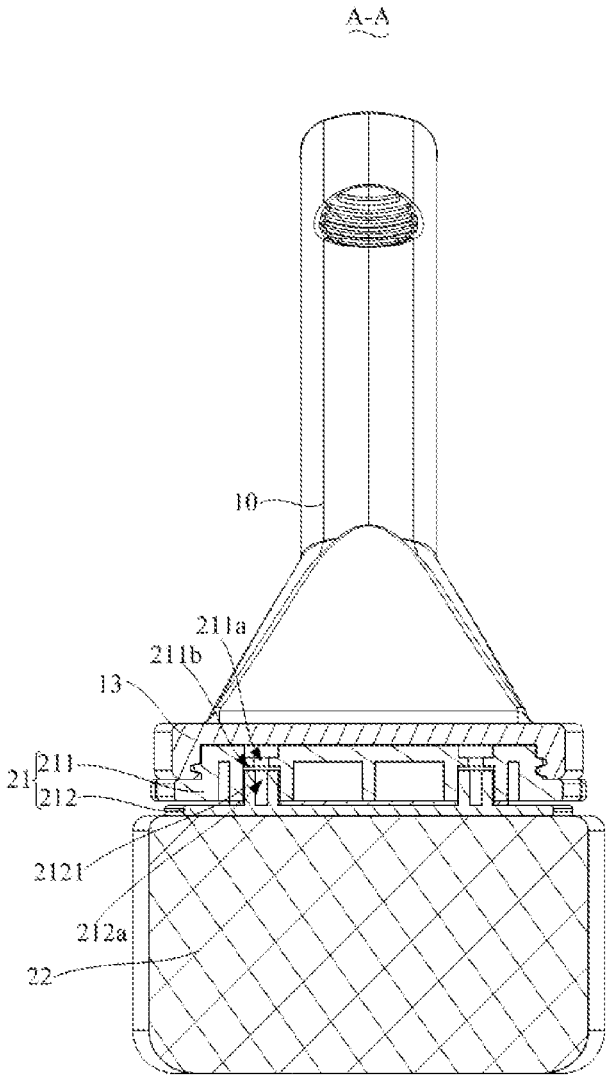
FIG. 6 is a cross sectional view of the cleaning brush of FIG. 5 along A-A line.

Please referring to FIG. 3 and FIG. 6 together, specifically, in the present disclosure, the surface of the scraper 23 is formed with four through holes 23*b* arranged at intervals through machining, and the through holes 23*b* are passed through the upper and lower surfaces of the scraper 23. The first seat body 211 and the second seat body 212 are integrally formed by plastic materials, and an overall shape of the first seat body 211 and the second seat body 212 is cylindrical. The positions of the connecting holes 212*a* formed in the first seat body 211 and the positions of mounting holes 212*a* formed in the second seat body 212 are compatible with the positions of the through holes 23*b* of the scraper 23. The first seat body 211 is located on a side of the scraper 23 facing towards the cleaning end 13, and the second seat body 212 is located on an opposite side of the first seat body 211, that is, the first seat body 211 and the second seat body 212 are located on the two opposite sides of the scraper 23. One connecting element passes through one connecting hole 211*a*, one through hole 23*b* and one mounting hole 212*a* to connect the scraper 23 with the first seat body 211 and the second seat body 212.

In an embodiment of the present disclosure, the connecting element is a screw, so the mounting hole 212*a* is internally provided with a thread, the connecting element is sequentially passed through the connecting hole 211*a* and the through hole 23*b* and then screwed into the mounting hole 212*a*, to connect and fix the first seat body 211, the scraper 23, and the second seat body 212 together. In this way, the connection of the scraper 23 is relatively stable, and it is convenient to disassemble and assemble the scraper 23. In another embodiment of the present disclosure, the connecting element is a pin, so the mounting hole 212*a* is a pin hole, the connecting element is sequentially passed through the connecting hole 211*a* and the through hole 23*b* and then inserted into the mounting hole 212*a*, to connect and fix the first seat body 211, the scraper 23, and the second seat body 212 together. In this way, the connection of the scraper 23 is stable, and it is convenient to disassemble and assemble the scraper 23.

Of course, the scraper 23, the first seat body 211, and the second seat body 212 can also be connected by other detachable connection structures, for example, the scraper 23 is clamped between the first seat body 211 and the second seat body 212, and the first seat body 211 and the second seat body 212 are fixedly connected by snaps, or the first seat body 211 and the second seat body 212 are screwed and fixed together, and the scraper 23 is clamped and fixed therebetween. Alternatively, after the first seat body 211 and the second seat body 212 clamp and fix the scraper 23, the first seat body 211 and the second seat body 212 are fixed together by glue or hot melt, so that the installation of the scraper 23 is more stable, and the cleaning brush 100 has a simpler structure is simpler and is easier to assemble.

Further, in order to make the assembly of the scraper 23 more convenient. In an embodiment of the present disclosure, a plurality of positioning posts 2121 are protruded from a surface of the second seat body 212 towards the first seat body 211, and the plurality of positioning posts 2121 and the second seat body 212 are integrally formed, and the setting positions of positioning posts 2121 are adapted to the through holes 23*b* in the scraper 23. The mounting holes 212*a* of the second seat body 212 are defined in the positioning posts 2121, and a diameter of the positioning post 2121 is slightly smaller than a diameter of the through hole 23*b*. The surface of the first seat body 211 towards the second seat body 212 is recessed to form a plurality of positioning holes 211*b*. The positioning holes 211*b* are communicated with the connecting holes 211*a*, that is, the positioning hole 211*b* and the connecting hole 211*a* are combined to form a trapezoidal hole. An aperture of the positioning hole 211*b* is slightly larger than the diameter of the positioning post 2121.

During an actual installation, the four positioning posts 2121 on the second seat body 212 are respectively passed through the four through holes 23*b* in the scraper 23, and accommodated in the four positioning holes 211*b* in the first mounting seat 21, to pre-position the first seat body 211, the scraper 23, and the second seat body 212, and then the connecting element is passed through the connecting hole 211*a*, the through hole 23*b*, and the mounting hole 212*a* in sequence to connect and fix the first seat body 211, the scraper 23, and the second seat body 212. In the present disclosure, by providing four positioning posts 2121, on the one hand, the assembly of the scraper 23 can be facilitated; on the other hand, through a limiting function of the positioning post 2121, the scraper 23 can be limited after being connected and fixed, so as to avoid a situation that the scraper 23 is forced to deflect when scraping the stains, and the use performance of the cleaning brush 100 is more stable.

Figure 2:
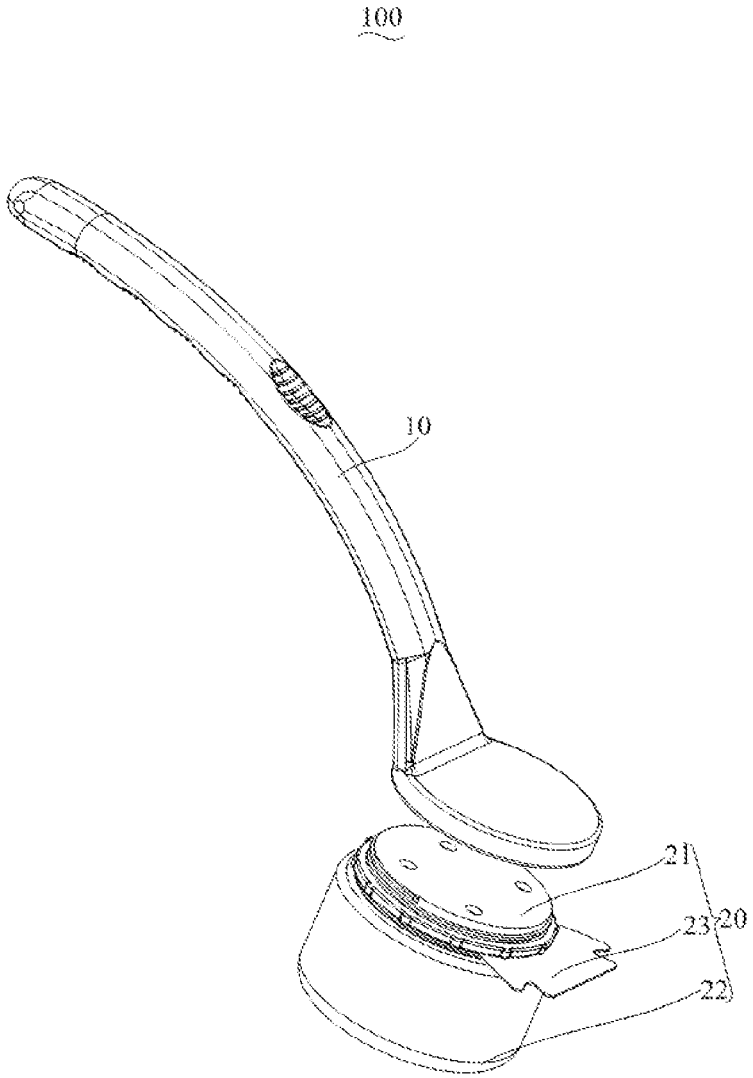
FIG. 2 is an exploded view of the cleaning brush of FIG. 1.

Please referring to FIG. 2 and FIG. 3 again, in order to facilitate the overall disassembly and assembly of the cleaning assembly 20, in an embodiment of the present disclosure, the cleaning end 13 is provided with an inserting hole 13 *a*, and a side of the first seat body 211 towards the cleaning end 13 is protruded with a connecting protrusion 2112, and the connecting protrusion 2112 is inserted into the inserting hole 13 *a*, to connect the first seat body 211 with the cleaning end 13.

Specifically, one of a side wall of the inserting hole 13*a* and the connecting protrusion 2112 is provided with an external thread, and the other of the two is provided with an internal thread. In the present disclosure, the side wall of the inserting hole 13*a* is provided with the internal thread, and an outer side of the connecting protrusion 2112 is provided with the external thread. The connecting protrusion 2112 is inserted into the inserting hole 13*a*, and the first seat body 211 and the cleaning end 13 are connected and fixed through the threaded structure, so that the connection between the brush handle 10 and the cleaning assembly 20 is more stable, it is also easier to disassemble the brush handle 10 and the cleaning assembly 20.

Further, in order to facilitate user to rotate the first seat body 211, and then disassemble and assemble the cleaning assembly 20, in an embodiment of the present disclosure, the mounting seat 21 further includes a plurality of anti-slip protrusions 213, and the anti-skid protrusions 213 are arranged at intervals on the outer side of the first seat body 211 and are evenly spaced along a circumferential direction of the first seat body 211. Cross-sections of the anti-skid protrusions 213 are semicircular, and are integrally formed with the first seat body 211. In the present disclosure, the anti-slip protrusions 213 in a semicircle shape can facilitate user to rotate and assemble the cleaning assembly 20, so that the disassembly and assembly are labor saving, and the feel in disassembly and assembly is much better.

The above description is merely some embodiments. It should be noted that for one with ordinary skills in the art, improvements can be made without departing from the concept of the present disclosure, but these improvements shall fall into the protection scope of the present disclosure.

What is claimed is:

1. A cleaning brush, comprising:

a brush holder, comprising a main body, a grip end, and a cleaning end, the grip end and the cleaning end are arranged at two opposite ends of the main body, respectively; and a cleaning assembly, comprising a mounting seat, bristles, and a scraper, the mounting seat is detachably connected to the cleaning end, the bristles and the scraper are connected to the mounting seat, a side of a cutting edge of the scraper towards the mounting seat is recessed to form a profile cleaning groove;

wherein the scraper defines a plurality of through holes penetrating through upper and lower surfaces of the scraper, the cleaning assembly further comprises a plurality of connecting elements, the mounting seat comprises a first seat body and a second seat body, the first seat body defines a plurality of connecting holes, and the second seat body defines a plurality of mounting holes, the first seat body is detachably connected to the cleaning end, and the bristles are connected to the second seat body;

the scraper is clamped between the first seat body and the second seat body, and one connecting element is passed through one connecting hole, one through hole and one mounting hole, to connect the scraper with the first seat body and the second seat body; and the cleaning end defines an inserting hole, and a side of the first seat body towards the cleaning end comprises a connecting protrusion, and the connecting protrusion is inserted into the inserting hole, to connect the first set body with the cleaning end.

2. The cleaning brush of claim 1, wherein a side of the profile cleaning groove towards the cutting edge is arranged in a flared shape.

3. The cleaning brush of claim 1, wherein a bottom wall of the profile cleaning groove is in a circular arc shape.

4. The cleaning brush of claim 1, wherein a plurality of positioning posts are protruded from a surface of the second seat body towards the first seat body, one positioning post defines one mounting hole, a surface of the first seat body towards the second seat body is recessed to form a plurality of positioning holes, and one positioning hole is communicated with one connecting hole; and one positioning post is passed through one through hole and inserted into one positioning holes.

5. The cleaning brush of claim 1, wherein one of a side wall of the inserting hole and the connecting protrusion comprises an external thread, and another one of the inserting hole and the connecting protrusion comprises an internal thread.

6. The cleaning brush of claim 1, wherein the mounting seat further comprises a plurality of anti-slip protrusions, and the anti-skid protrusions are arranged at intervals on an outer side of the first seat body and are evenly spaced along a circumferential direction of the first seat body.

7. The cleaning brush of claim 1, wherein the bristles are made of fireproof cloth.

8. The cleaning brush of claim 1, wherein the main body is extended in a circular arc shape, and a center of the circular arc is arranged on a side of the mounting seat.

9. The cleaning brush of claim 2, wherein the bristles are made of fireproof cloth.

10. The cleaning brush of claim 2, wherein the main body is extended in a circular arc shape, and a center of the circular arc is arranged on a side of the mounting seat.

11. The cleaning brush of claim 3, wherein the bristles are made of fireproof cloth.

12. The cleaning brush of claim 3, wherein the main body is extended in a circular arc shape, and a center of the circular arc is arranged on a side of the mounting seat.

13. The cleaning brush of claim 4, wherein the bristles are made of fireproof cloth.

14. The cleaning brush of claim 4, wherein the main body is extended in a circular arc shape, and a center of the circular arc is arranged on a side of the mounting seat.

* * * * *